United States Patent [19]

Indra

[11] 4,099,894

[45] Jul. 11, 1978

[54] FUEL INJECTION FOR DIESEL ENGINES HAVING CONTROLLED-RATE PRESSURE RELIEF MEANS

[75] Inventor: Jaromir Indra, Brno, Czechoslovakia

[73] Assignee: Vysoke uceni technicke, Brno, Czechoslovakia

[21] Appl. No.: 649,358

[22] Filed: Jan. 15, 1976

[30] Foreign Application Priority Data

Jan. 15, 1975 [CS] Czechoslovakia ..... 262-75

[51] Int. Cl.[2] ..... F04B 39/10; B05B 1/30

[52] U.S. Cl. ..... 417/499; 239/533.7; 137/538; 417/569

[58] Field of Search ..... 417/490, 569, 307, 499, 417/501; 239/533.7, 533.12; 137/538, 514

[56] References Cited

U.S. PATENT DOCUMENTS

| | | | |
|---|---|---|---|
| 1,933,454 | 10/1933 | Sidney | 239/533.7 |
| 2,033,839 | 3/1936 | Lawson | 137/538 |
| 2,090,688 | 8/1937 | Lindberg | 417/569 |
| 2,665,167 | 1/1954 | High | 239/533.12 |
| 2,922,581 | 1/1960 | Garday | 417/569 |
| 3,332,408 | 7/1967 | Scott et al. | 239/453 |
| 3,340,860 | 9/1967 | Groschel et al. | 417/307 |
| 3,773,440 | 11/1973 | Tateishi | 417/490 |

FOREIGN PATENT DOCUMENTS

| | | | |
|---|---|---|---|
| 709,847 | 6/1954 | United Kingdom | 137/538 |

*Primary Examiner*—Carlton R. Croyle
*Assistant Examiner*—Thomas I. Ross

[57] ABSTRACT

A piston-type injection pump for supplying a nozzle-type injector in a diesel engine is provided with integral facilities for effecting the controlled expansion of the discharge conduit between the pump and the injector and with additional facilities for limiting the rate of pressure drop in the discharge conduit during the volume expansion step. A cylindrical member disposed in a chamber that is in fluid communication with the working chamber defined by the piston-cylinder portion of the pump slidably receives an elongated cylindrical valve that is normally biased into a flow-blocking condition. Such cylindrical member has associated therewith suitable relief elements, such as a separate relief valve carried axially therein, to permit expansion of the space above the cylindrical member and to thereby accommodate an expansion of fluid downstream of the pump at the conclusion of the pressure stroke of the piston. The pressure drop limitation in the discharge conduit is effected by the combination of the relief means and a separate reduced-area located at a selected point in the pump body between the fuel supply inlet port of the cylinder and the discharge end of the pump.

12 Claims, 8 Drawing Figures

FUEL INJECTION FOR DIESEL ENGINES HAVING CONTROLLED-RATE PRESSURE RELIEF MEANS

BACKGROUND OF THE INVENTION

The invention relates to piston-type injection pumps adapted to supply fuel to nozzle-type injectors in diesel engines, and more particularly to injection pumps of this general type which have facilities for providing pressure relief in the discharge conduit between the pump and the injector after the piston pump has completed its pressure stroke.

In certain known types of injector pumps of this general design, the pressure regulating facilities are in the form of discharge valves that ideally assure that sufficient pressure is maintained in the discharge conduit immediately after conclusion of the pressure stroke to prevent an undesired influx of gases from the engine combustion chamber to the fuel supply reservoir of the pump. Unfortunately, existing types of such discharge valves are bulky, complicated and generally unreliable.

As an alternative to such discharge valves, certain injection pump designs employ pressure-regulation facilities in the form of systems of throttling channels, usually in the fuel by-pass path of the pump. Such channels serve to increase backpressure in the discharge line. These arrangements have the disadvantage of being not only complex but also of yielding a rapid change of pressure with even small changes in the depth of the throttling channels. Additionally, when such expedients are used, it is observed that upon failure of the injector nozzle and/or shutdown of the injector, such throttling channels permit an undesired flow of combustion gases or residual pressurized air in the nozzle toward the fuel supply reservoir in the pump.

SUMMARY OF THE INVENTION

The arrangement of the present invention provides a relatively simple and easily constructed means of assuring a controlled-rate pressure relief in the discharge line while simultaneously assuring fail-safe insurance against the introduction of undesired gases into the pump supply channels.

In an illustrative embodiment, a chamber disposed downstream of the working chamber of the pump houses a cylindrical valve supported for reciprocation between a normal fuel-blocking position and an operated flow-effecting position. The cylindrical member is suspended in the associated chamber by one or more springs which operate as relief elements either alone or in combination with a separate valve element that is supported for axial movement with respect to the main cylindrical member.

Because of the expansion of fluid in the discharge conduit accompanying the end of the prewsure stroke of the piston, the relief facilitates within the pump body effect an expansion of the space above the cylindrical member, illustratively by providing an upstream movement of the cylindrical member or the associated auxiliary valve. Such upstream movement perfects a seal of the valve arrangement against an associated valve seat in the chamber, so that in the event of failure of the engine, any residual gases flowing from the injector toward the pump will be prevented from reaching the supply reservoirs of the pump.

In accordance with one feature of the invention, the rate of volume expansion, and thereby of pressure drop, within the discharge conduit after the pressure stroke is suitably limited so that the total pressure in the discharge conduit when the injector nozzle is closed is at least 40% of the corresponding pressure when such nozzle is open. This is accomplished by illustratively associating with the relief facilities in the pump a restricted-area passage of suitable cross-section, such passage being disposed in an arbitrary portion of the pump body.

BRIEF DESCRIPTION OF THE DRAWING

The invention is further set forth in the following detailed description taken in conjunction with the appended drawing, in which:

FIG. 8 is a representation illustrating an axial section of the top portion of yet another alternative to the pump arrangement of FIG. 1, together with an axial section of a typical diesel injector associated therewith.

DETAILED DESCRIPTION

Figure 1:
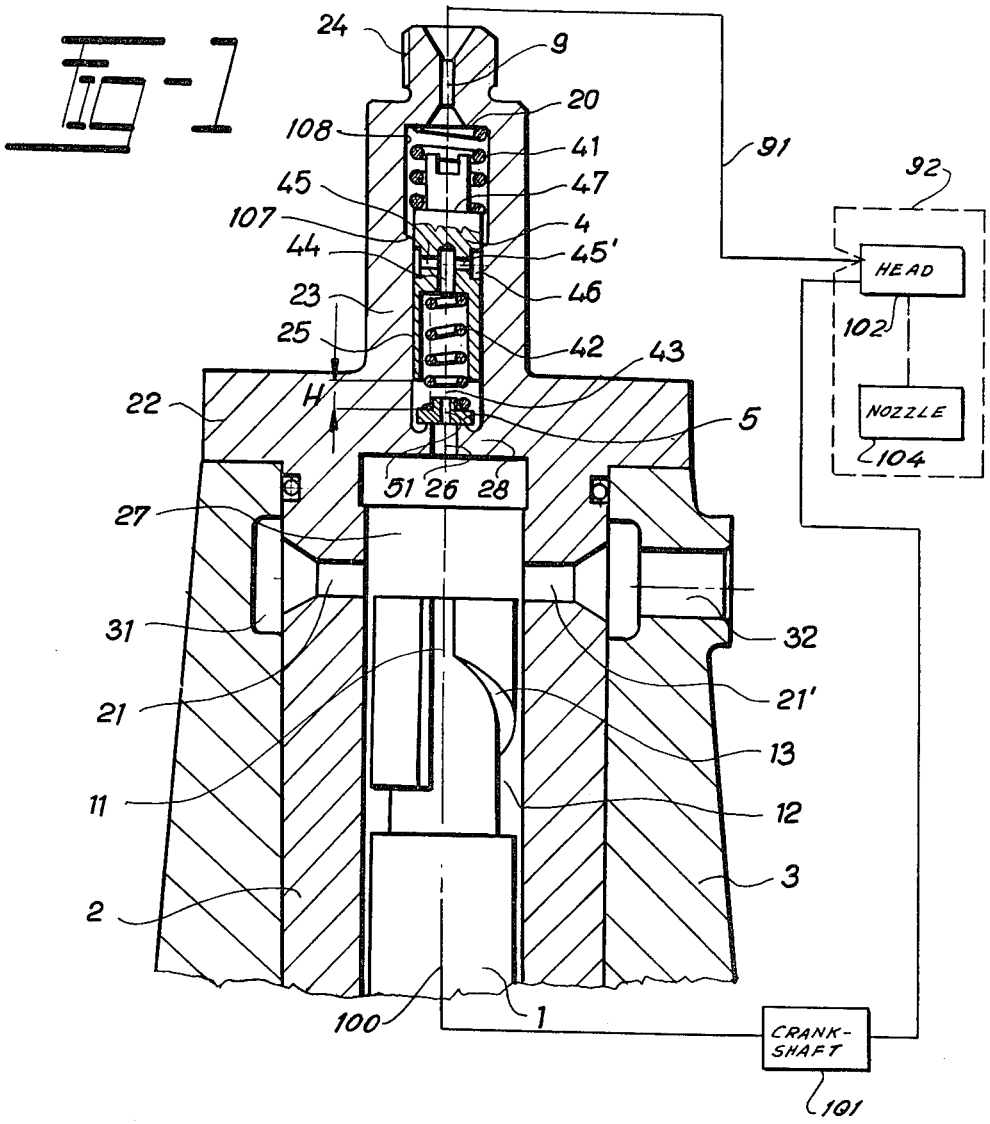
FIG. 1 is a combined block and mechanical schematic representation of an arrangement within a diesel engine for pumping fuel to a nozzle-type injector.

Referring now to FIG. 1, there is depicted an injection pump constructed in accordance with the invention. The upper portion of a pump piston 1 is provided with a longitudinal groove 11 and with an underlying recess 12, which cooperates to form a profiled regulating edge 13 of helical form. The piston 1 is supported for rotation about and reciprocation along an axis 100 in a cylinder 2 having two radial fuel supply channels 21, 21'. The cylinder 2 has a flange 22, which projects into an extension 23 terminated by a threaded coupling member 24 for connection to a discharge conduit 91. The conduit 91 guides fuel discharged by the pump during the pressure stroke of the piston into a nozzle-type injector 92.

The flange 22 of the cylinder 2 is coupled by suitable means (not shown) to a case 3 of the pump. A filling chamber or reservoir 31 is provided in the case 3 in alignment with the radial channels 21, 21'. The case 3 further includes a channel 32 for supplying fuel from a suitable source (not shown) into the filling chamber 31.

A discharge valve 4 is arranged in an internal chamber 25 within the extension 23, and as indicated below moves in an unobstructed manner within the chamber 25 between variable upstream and downstream positions. A spring 41 extends from the top surface of the chamber 25 to the top of the valve 4, while a second spring 42 extends from a check-type return valve 5 upwardly to contact the opposite end of the valve 4. The valve 5 is adapted to selectively close a channel 26 that connects a main working space 27 of the cylinder 2 above the piston 1 with a space 43 below the valve 4.

The return valve 5 has a restricted-area channel 51 extending therethrough.

The valve 4 exhibits a blind axial channel 44, which is connected with radial channels 45, 45'. The channels 45, 45' terminate in a circular recess 46 on the external circumference of the valve 4 below a cylindrical upper part 47 thereof.

Figure 2:
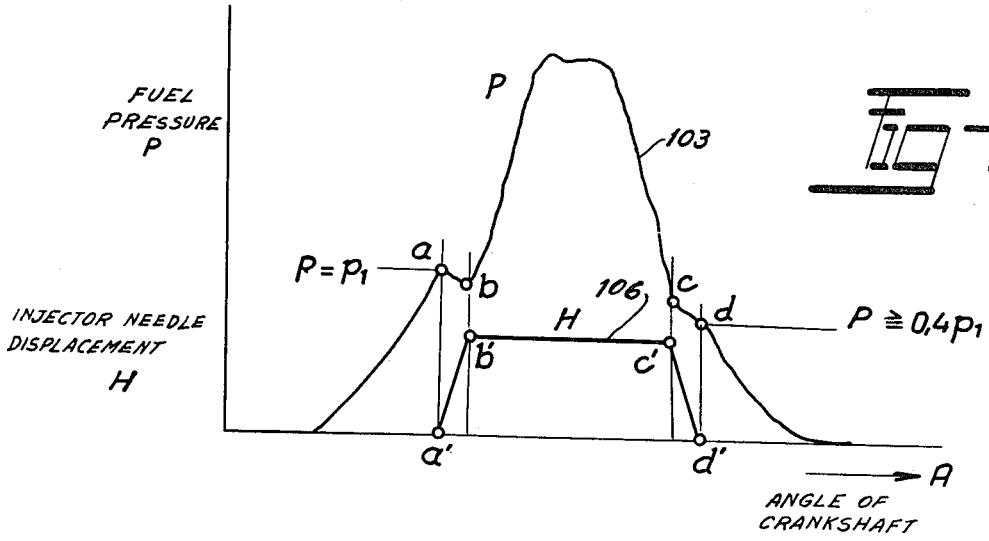
FIG. 2 is a composite diagram illustrating the fuel pressure in the arrangement of FIG. 1, together with the then-occurring position of the injector nozzle, as a function of crankshaft angle.

A crankshaft 101 conventionally drives the piston 1 and a head 102 of the injector 92 in timed relation to yield the relations shown in FIG. 2. In particular, FIG. 2 indicates schematically a course 103 of the fuel pressure P upstream of nozzle 104 of the injector 92. The figure also depicts a course 106 of the simultaneous displacement H of the associated injector needle as a function of the attained angle A of the crankshaft 101 with respect to a reference angle. The mutually corresponding points *a-a'* in FIG. 2 represent the start of the displacement of the needle; points *b-b'*, the needle in the uppermost position in the injector; points *c-c'*, the start of the descent of the needle toward its seat; and *d-d'*, the contact of the needle with its seat.

It will be assumed that the pre-stress of springs 41 and 42 in FIG. 1 is adjusted such that the upper end of the recess 46 in the valve 4 coincides with an interface 107 of the main portion of the chamber 25 with an upper, somewhat widened extension 108 thereof.

The operation of the arrangement of FIG. 1 is as follows: At the start of the pressure stroke of the piston 1, the initially open radial supply channels 21, 21' are blocked by the upper part of the piston, so that the return valve 5 and the discharge valve 4 are both raised from their illustrated positions because of the pressure of the fuel. Such movement permits the through-flow of fuel from the cylinder working space 26 through space 43, axial channel 44, radial channels 45, 45', the now-exposed recess 46 into the space above the valve 4, and over discharge conduit 91 to the injector 92.

As the piston continues its movement, one of the radial channels 21 is exposed by the successive portions of the regulating edge 13 of the piston 1. As a result, the fuel pressure in the cylinder working space 23 progressively drops, and the rate of discharge of fuel into the discharge conduit 91 progressively diminishes, finally reaching zero at the conclusion of the pressure stroke.

When this happens, the valve 4 moves back to its initial position under the urging of the spring 41, and the check valve 5 closes. Subsequently, as the relevant channel 21 becomes more exposed, the relatively increased pressure in the discharge conduit 91 starts to move the valve 4 downwardly, thereby increasing the effective space in the chamber 25 above the valve 4, thereby to accommodate an increase in volume of the now-expanding fuel in the discharge conduit 91.

During the decrease in pressure through the pump and the discharge line 91, as represented by the decreasing portion of the curve 103 of FIG. 2, the injector nozzle needle starts to descend, and at point d, the nozzle closes. Since such operations take place as the fuel in the conduit 9 is expanding, any tendency of residual gases to flow from the combustion space (not shown) of the engine back toward the reservoirs 31 of the pump is inhibited by the restoration of the original positions of the valves 4 and 5.

Advantageously, the pressure in the discharge conduit 91 at the time that the injector nozzle needle is closed (point *d-d'* in FIG. 2) is made equal to at least 40% of the pressure which exists in such conduit at the time that the nozzle is opened (point *a-a'* in FIG. 2). Such relationship is easily accomplished by suitable selection of the cross-section of the restricted passage 51 in the valve 5. Such valve 5 cooperates with the pressure relief arrangement within the cylinder 25 to limit the rate of pressure drop therein.

The downward movement of the valve 4 from its initial position toward the valve 5 during the pressure relief operation is determined by the expansion of the fuel in the conduit 91 toward a reference value, in this case the relatively low pressure in the fuel reservoir 33. Such expansion requirements are in turn determined by the speed of the engine and the magnitude of the dose of fuel injected during the pressure stroke. In general, the initial distance H (FIG. 1) between the bottom of the valve member 4 and its seat represented by the top of the check valve 5 is chosen such that under maximum speed and dosing conditions of the engine, the bottom of the valve 4 stops just short of the seat under the action of the corresponding maximum expansion of fuel in the conduit 91. When such bottom-most position is reached, the pressure in the pump and in the conduit 91 is approximately equal to the reference pressure in the reservoir 31; in practice, the pressure in the conduit 91 is somewhat higher, because of the added compression stress on the spring 42 when the valve 4 is urged downwardly.

When the piston 1 starts its suction stroke, the initial downward movement of the portions 12 and 13 of the piston past the fuel supply channels 21, 21' results in the working space 27 being filled with fuel vapors. Because of the above-mentioned downward pressure of the now-compressed spring 42, such fuel vapors are prevented from passing in a downstream direction toward the discharge conduit 91. Subsequently, as the top edge of the piston moves down past the supply channel 21, liquid fuel from the reservoir 31 fills up the working space 27. Because of the now-present communication between the space 27 and the reservoir 31, and because of the action of the now-stressed spring 42, the transition from fuel vapor to liquid fuel in the space 27 is insulated from conditions in the conduit 91. Also, as indicated above, the valves 4 and 5 are in their upstream position; consequently, no undesired fluid flow can reach the body of the pump during such suction stroke.

It will be appreciated that when the engine speed and dosing conditions are less than the maximum assumed above, the necessary degree of downward movement of the valve 4 from its initial position illustrated in order to equalize the pressure in the conduit 91 to that in the reservoir 31 will be less than the movement necessary under maximum load conditions. Thus, the equilibrium relief position of the valve 4 will be higher, so that such valve 4 will operate as an improved form of constant-pressure valve; in particular, such valve will always effect a release of the pressure in the conduit 91 to a constant final pressure approximately equal to that in the reservoir 33. Consequently, a regular-stable injection of even very small fuel doses during the pressure stroke of the piston is assured.

Figure 3:
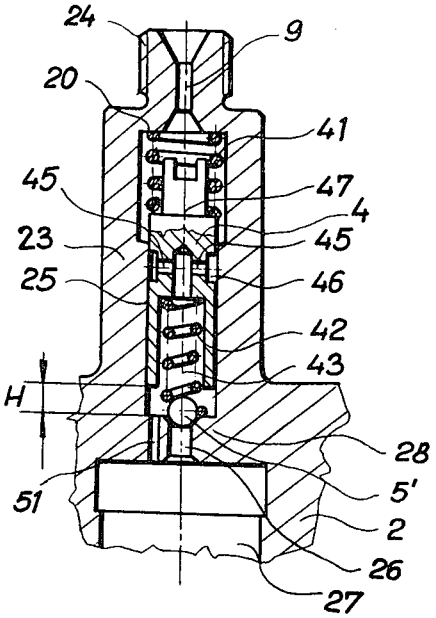
FIG. 3 is an axial section of a first alternative to the pressure-regulating facilities in the pump of FIG. 1.

FIG. 3 illustrates an alternative arrangement of the valve and relief facilities in the upper portion of the pump. In this case, the check valve is in the form of a solid ball, and the required restricted-area passage 51 for limiting the rate of pressure drop in the conduit following the pressure stroke extends parallel to the relatively large-area channel 26 in a bottom portion 28 of the cylinder extension 23. As before, the width of the channel 51 is selected so that the closing nozzle pressure is at least 40% of the opening nozzle pressure.

Figure 4:
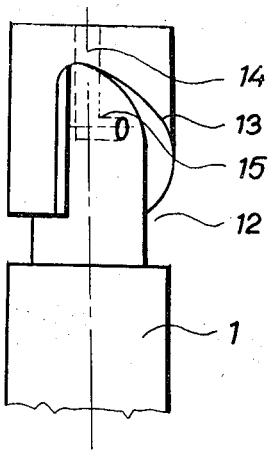
FIG. 4 is a longitudinal view of an alternative form of piston suitable for use in the arrangement of FIG. 1.

In FIG. 4, the required restricted channel is disposed in the piston 1 itself, and is formed from an axial channel 14 extending into the piston 1 from a top surface thereof, such axial channel 14 being in communication with a radial channel 15 at its inner end. The radial channel terminates at its outer end on the periphery of the recessed portion 12 of the piston, the piston construction of FIG. 4 is useful in arrangements, such as those described below in connection with FIGS. 5 and 6, wherein fluid communication is provided between the interior of the chamber 25 and the downstream end of the axial channel 14.

Figure 5:
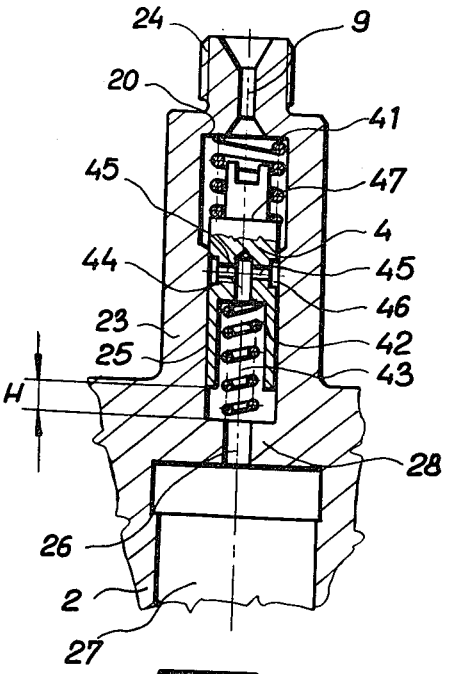
FIGS. 5, 6, and 7 are respective axial elevations of the top portions of alternative forms of pumps suitable for use in the arrangement of FIG. 1.

In FIG. 5, the check valve 5 in FIGS. 1 and 3 has been eliminated, and the bottom of the lower spring 42 bears directly against the bottom of the channel 25. The required restricted-area passage for limiting the rate of pressure drop can be accomplished in such arrangement, e.g., by employing the piston design of FIG. 4.

Figure 6:
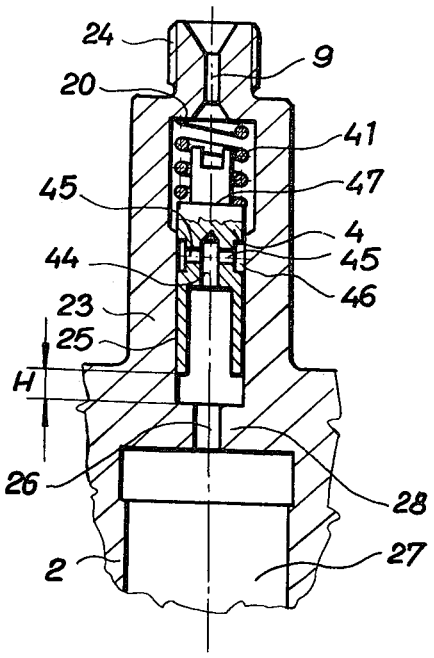

In FIG. 6, the spring 42 of FIG. 5 has been eliminated, but is otherwise identical to such figure in all respects. The arrangement of FIG. 6 functions approximately the same as that in FIG. 5, except that during the downward relief movement of the piston 4, the slightly higher pressure maintained in the discharge conduit with respect to the pump fuel reservoir is eliminated.

Figure 7:
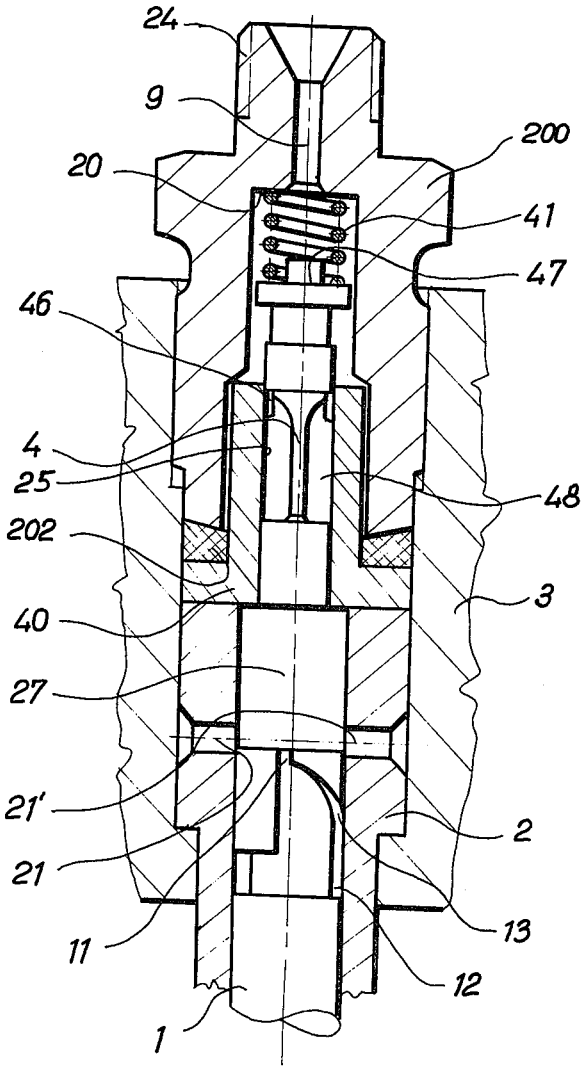
Figure 1:
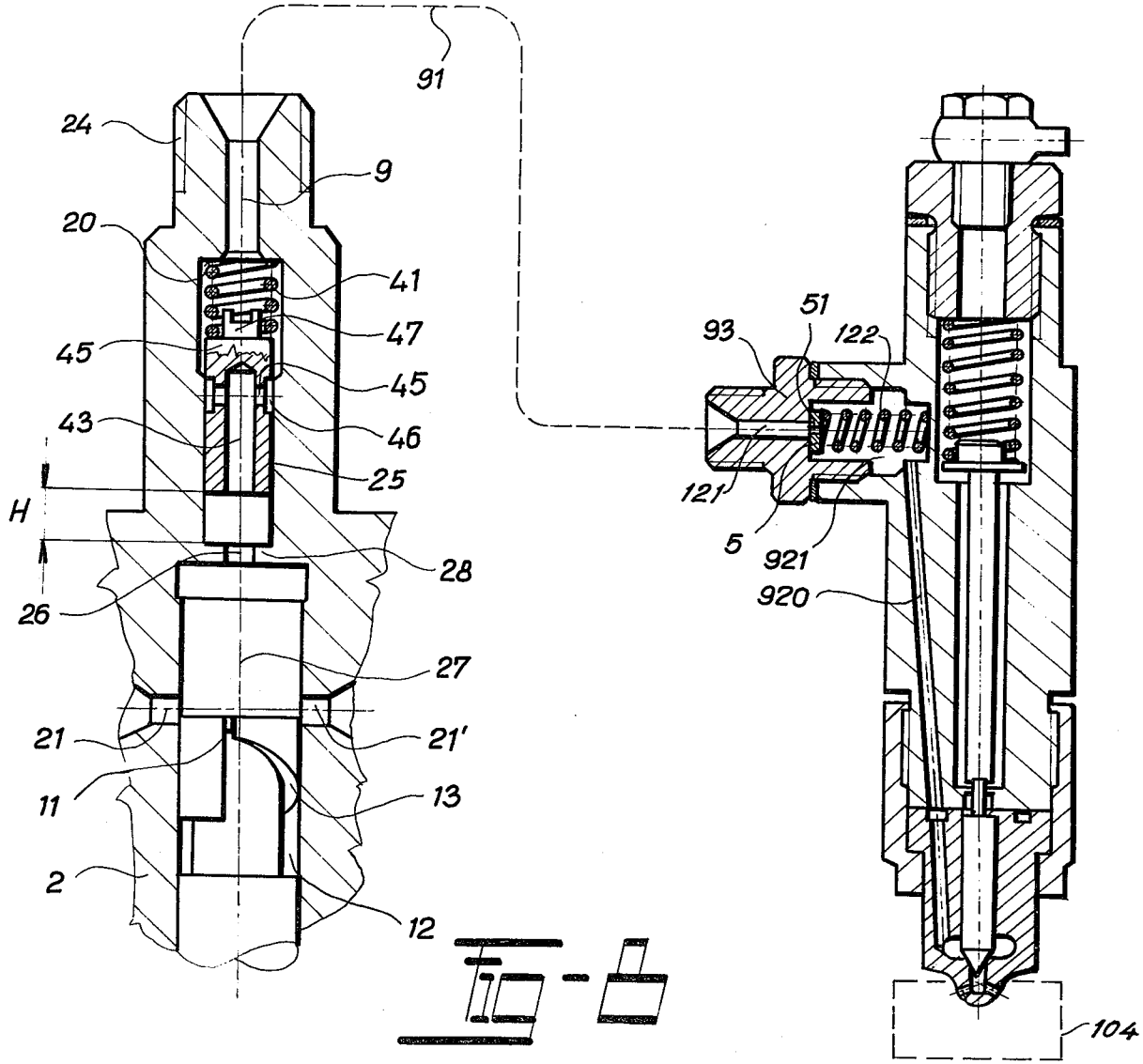

In the arrangement of FIG. 7, the threaded transition piece 24 between the pump and the discharge conduit is formed as a part of a separate member 200, which is threaded into the case 3 of the pump rather than being integral with the cylinder as in FIG. 1. The body housing the chamber 25 is also made separate from the cylinder 2, and is represented by the member 40 in FIG. 10. To prevent undesired leakage and pressure drop, the interface between the member 40 and the overlying member 200 is sealed by means of a packing 202.

In FIG. 8, the association of an injection pump with one embodiment of a nozzle-type diesel fuel injector 92 through the conduit 91 is depicted. In this case, the required restricted-area passage necessary for the limitation of the rate of pressure drop in the conduit 91 is disposed within a check valve 5 in the injector 92. In particular, such check valve 5 is adapted to close an inlet passage 121 of the nozzle 92, and is disposed on the upstream end of a recess 921. The valve 5 is biased into its closed position by means of a spring 122. The arrangement of FIG. 11 is presented to show that the desired cooperation of the restricted-area passage 51 and the pressure-relief facilities in the pump chamber 25 need not be in the same components of the engine, but can be disposed on opposite ends of the discharge conduit 91.

In the foregoing, several illustrative arrangements of the invention have been set forth. Many variations and modifications will now occur to those skilled in the art. It is accordingly desired that the scope of the appended claims not be limited to the specific disclosure herein contained.

What is claimed is:

1. In a piston-type injection pump for supplying fuel downstream over a discharge channel to a nozzle-type diesel injector, the pump comprising, in combination, a cylinder having a fuel supply port in a transverse wall thereof, a piston supported for reciprocation in the cylinder to define pressure and suction strokes of the pump, the piston having a profiled peripheral edge cooperable with the fuel supply port in the cylinder during the piston movement for effecting a flow of fuel through the fuel supply port, the space between the piston and the associated end of the cylinder defining a first chamber, means associated with the cylinder and disposed downstream of the first chamber for defining a second chamber separated from the first chamber, means providing fluid communication between the first and second chambers, the downstream end of the second chamber communicating with the upstream end of the discharge channel, discharge valve means supported for unobstructed movement in the second chamber between variable upstream and downstream positions, the valve means being movable upstream from a downstream position thereof at the end of each pressure stroke of the piston by a variable distance necessary to effect a drop of pressure in the discharge channel from the value then existing therein to a reference value and thereafter being movable downstream from the resulting variable upstream position during the next succeeding pressure stroke of the piston, and means disposed between the fuel supply port in the cylinder and the downstream end of the second chamber and independent of the second chamber defining a restricted passage for providing a fluid return path from the second chamber to the fuel supply port and for limiting the rate of pressure drop in the discharge channel.

2. A pump as defined in claim 1, further comprising crank means for moving the piston in timed relation to the nozzle opening of the injector, the cross-section of the restricted passage being so chosen that the pressure in the discharge channel at the instant that the crank means closes the nozzle is at least 40% of the pressure in the discharge channel at the instant that the crank means opens the nozzle.

3. A pump as defined in claim 1, further comprising reservoir means in communication with the upstream end of the fuel supply channel in the cylinder, the reservoir exhibiting the reference value of pressure.

4. A pump as defined in claim 1, in which the second chamber has top and bottom walls, in which the bottom wall of the second chamber exhibits a relatively large-area passage interconnecting the first and second chambers, in which the valve means comprises a substantially cylindrical member supported for reciprocation in the second chamber, the cylindrical member exhibiting a blind axial channel extending therein from its bottom end, an upper peripheral recess, and at least one radial channel interconnecting the blind axial bore with the circumferential recess, and in which the pump further comprises a first spring extending from the top wall of the second chamber into engagement with the top of the cylindrical member for normally maintaining the cylindrical member a predetermined distance above the bottom wall of the second chamber.

5. A pump as defined in claim 4, further comprising a second spring extending upwardly from the bottom wall of the second chamber to the bottom of the blind axial channel.

6. A pump as defined in claim 1, in which the restricted passage is defined by a longitudinal groove on the circumference of the piston, the groove extending in an upstream direction from the downstream end of the piston.

7. A pump as defined in claim 1, in which the restricted passage is defined by the combination of an axial bore extending inwardly through the piston from the downstream end thereof, and a radial bore extending from the interior end of the last-mentioned axial bore to the circumference of the piston.

8. In a piston-type injection pump for supplying fuel downstream over a discharge channel to a nozzle-type diesel injector, the pump comprising, in combination, a cylinder having a fuel supply port in a transverse wall thereof, a piston supported for reciprocation in the cylinder to define pressure and suction strokes of the pump, the piston having a profiled peripheral edge cooperable with the fuel supply port in the cylinder during the piston movement for effecting a flow of fuel through the fuel supply port, the space between the piston and the associated end of the cylinder defining a first chamber, means associated with the cylinder and disposed downstream of the first chamber for defining a second chamber separated from the first chamber, means providing fluid communication between the first and second chambers, the downstream end of the second chamber communicating with the upstream end of the discharge channel, discharge valve means supported for unobstructed movement in the second chamber between variable upstream and downstream positions, the valve means being movable upstream from a downstream position thereof at the end of each pressure stroke of the piston by a variable distance necessary to effect a drop of pressure in the discharge channel from the value then existing therein to a reference value and thereafter being movable downstream from the resulting variable upstream position during the next succeeding pressure stroke of the piston, and means disposed between the fuel supply port in the cylinder and the downstream end of the second chamber and independent of the second chamber defining a restricted passage for providing a fluid return path to the fuel supply port and for limiting the rate of pressure drop in the discharge channel, the means providing fluid communication between the first and second chambers comprising a relatively large-area passage interconnecting the first and second chambers, and a check valve disposed in the second chamber for normally closing the large-area passage, the restricted-area passage extending through the check valve.

9. A pump as defined in claim 8, in which the restricted passage extends parallel to the large-area passage to also interconnect the first and second chambers, and in which the check valve is disposed in the second chamber for normally closing the large-area passage.

10. In a piston-type injection pump for supplying fuel downstream over a discharge channel to a nozzle-type diesel injector, the pump comprising, in combination, a cylinder having a fuel supply port in a transverse wall thereof, a piston supported for reciprocation in the cylinder to define pressure and suction strokes of the pump, the piston having a profiled peripheral edge cooperable with the fuel supply port in the cylinder during the piston movement for effecting a flow of fuel through the fuel supply port, the space between the piston and the associated end of the cylinder defining a first chamber, means associated with the cylinder and disposed downstream of the first chamber for defining a second chamber separated from the first chamber, means providing fluid communication between the first and second chambers, the downstream end of the second chamber communicating with the upstream end of the discharge channel, discharge valve means supported for unobstructed movement in the second chamber between variable upstream and downstream positions, the valve means being movable upstream from a downstream position thereof at the end of each pressure stroke of the piston by a variable distance necessary to effect a drop of pressure in the discharge channel from the value then existing therein to a reference value and thereafter being movable downstream from the resulting variable upstream position during the next succeeding pressure stroke of the piston, and means disposed between the fuel supply port in the cylinder and the downstream end of the second chamber and independent of the second chamber defining a restricted passage for providing a fluid return path to the fuel supply port and for limiting the rate of pressure drop in the discharge channel, the second chamber having top and bottom walls, the bottom wall of the second chamber exhibiting a relatively large-area passage interconnecting the first and second chambers, the discharge valve means comprising a substantially cylindrical member supported for reciprocation in the second chamber, the cylindrical member exhibiting a blind axial channel extending therein from its bottom end, an upper peripheral recess, and at least one radial channel interconnecting the blind axial bore with the peripheral recess, a first spring extending from the top wall of the second chamber into engagement with the top of the cylindrical member for normally maintaining the cylindrical member a predetermined distance above the bottom wall of the second chamber, and a check valve disposed below the cylindrical member for normally closing the large-area passage in the bottom wall of the second chamber, the restricted-area passage extending parallel to the larger-area opening in the bottom wall of the second chamber.

11. A pump as defined in claim 10, further comprising a second spring extending upwardly from the check valve to the bottom of the blind axial channel in the cylindrical member.

12. In a piston-type injection pump for supplying fuel downstream over a discharge channel to a nozzle-type diesel injector, the pump comprising, in combination, a cylinder having a fuel supply port in a transverse wall thereof, a piston supported for reciprocation in the cylinder to define pressure and suction strokes of the pump, the piston having a profiled peripheral edge cooperable with the fuel supply port in the cylinder during the piston movement for effecting a flow of fuel through the fuel supply port, and space between the piston and the associated end of the cylinder defining a first chamber, means associated with the cylinder and disposed downstream of the first chamber for defining a second chamber separated from the first chamber, means providing fluid communication between the first and second chambers, the downstream end of the second chamber communicating with the upstream end of the discharge channel, discharge valve means supported for unobstructed movement in the second chamber between variable upstream and downstream positions, the valve means being movable upstream from a downstream position thereof at the end of each pressure stroke of the piston by a variable distance necessary to effect a drop of pressure in the discharge channel from the value then existing therein to a reference value and thereafter being movable downstream from the resulting variable upstream position during the next succeeding pressure stroke of the piston, and means disposed between the fuel supply port in the cylinder and the downstream end of the second chamber and independent of the second chamber defining a restricted passage for providing a fluid return path to the fuel supply port and for limiting the rate of pressure drop in the discharge channel, the second chamber having top and bottom walls, the bottom wall of the second chamber exhibiting a relatively large-area passage interconnecting the first and second chambers, the discharge valve means comprising a substantially cylindrical member supported for reciprocation in the second chamber, the cylindrical member exhibiting a blind axial channel extending therein from its bottom end, an upper peripheral recess, and at least one radial channel interconnecting the blind axial bore with the peripheral recess, a first spring extending from the top wall of the second chamber into engagement with the top of the cylindrical member for normally maintaining the cylindrical member a predetermined distance above the bottom wall of the second chamber, and a check valve disposed below the cylindrical member for normally closing the large-area opening in the bottom wall of the second chamber, the check value having the restricted passage extending therethrough.

* * * * *